US008970644B2

(12) United States Patent
Qi et al.

(10) Patent No.: US 8,970,644 B2
(45) Date of Patent: Mar. 3, 2015

(54) AMOLED DRIVING AND COMPENSATING CIRCUIT AND METHOD, AND AMOLED DISPLAY DEVICE

(71) Applicants: Boe Technology Group Co., Ltd., Beijing (CN); Chengdu Boe Optoelectronics Technology Co., Ltd., Sichuan (CN)

(72) Inventors: Xiaojing Qi, Beijing (CN); Tianma Li, Beijing (CN)

(73) Assignees: Boe Technology Group Co., Ltd., Beijing (CN); Chengdu Boe Optoelectronics Technology Co., Ltd., Chengdu, Sichuan (CN)

( * ) Notice: Subject to any disclaimer, the term of this patent is extended or adjusted under 35 U.S.C. 154(b) by 130 days.

(21) Appl. No.: 13/805,505

(22) PCT Filed: Sep. 26, 2012

(86) PCT No.: PCT/CN2012/082032

§ 371 (c)(1),
(2) Date: Dec. 19, 2012

(87) PCT Pub. No.: WO2013/063991

PCT Pub. Date: May 10, 2013

(65) Prior Publication Data

US 2014/0049568 A1 Feb. 20, 2014

(30) Foreign Application Priority Data

Nov. 1, 2011 (CN) ..... 2011 1 0340564

(51) Int. Cl.
*G09G 3/32* (2006.01)

(52) U.S. Cl.
CPC ..... *G09G 3/3258* (2013.01); *G09G 3/3233* (2013.01); *G09G 2300/0465* (2013.01); *G09G 2300/0819* (2013.01); *G09G 2300/0861* (2013.01); *G09G 2300/0876* (2013.01)
USPC ..... 345/690; 345/82

(58) Field of Classification Search
CPC ..... G09G 3/30; G09G 3/32; G09G 3/3208; G09G 3/3225; G09G 3/3233; G09G 3/3258
USPC ..... 345/76–83, 204–215, 690–693
See application file for complete search history.

(56) References Cited

U.S. PATENT DOCUMENTS

2005/0017934 A1 1/2005 Chung et al.
2005/0068271 A1 3/2005 Lo (Continued)

FOREIGN PATENT DOCUMENTS

CN 1601594 A 3/2005
CN 1917019 A 2/2007

(Continued)

OTHER PUBLICATIONS

International Search Report mailed Oct. 1, 2013; PCT/CN2012/082032.

(Continued)

*Primary Examiner* — Alexander Eisen
*Assistant Examiner* — Abhishek Saema
(74) *Attorney, Agent, or Firm* — Ladas & Parry LLP

(57) ABSTRACT

The present disclosure discloses an AMOLED driving and compensating circuit and method, and AMOLED display device. The driving and compensating circuit including: several driving circuits set inside several pixel regions used for driving several AMOLEDs; an external compensating circuit set outside the pixel regions used for eliminating an effect of threshold voltage of a driving thin film transistors in the several driving circuits set inside the several pixel regions on driving currents passing through the driving thin film transistors. The driving and compensating method including: storing threshold voltage of the driving thin film transistors of the several driving circuits set inside the several pixel regions; storing grayscale voltage of each of the several driving circuits set inside the several pixel regions; gate voltage of the driving thin film transistor of each of the several driving circuits set inside the several pixel regions jumping to a sum of the threshold voltage and the grayscale voltage of the driving circuit. The display device includes the AMOLED driving and compensating circuit.

9 Claims, 4 Drawing Sheets

(56) References Cited

U.S. PATENT DOCUMENTS

| | | | | |
|---|---|---|---|---|
| 2005/0280614 | A1 | 12/2005 | Goh | |
| 2007/0030217 | A1* | 2/2007 | Peng | 345/76 |
| 2008/0211397 | A1 | 9/2008 | Choi | |
| 2009/0079679 | A1* | 3/2009 | Nam | 345/82 |
| 2011/0063198 | A1* | 3/2011 | Chung et al. | 345/82 |

FOREIGN PATENT DOCUMENTS

| | | | |
|---|---|---|---|
| CN | 101192374 | A | 6/2008 |
| CN | 101281723 | A | 10/2008 |
| CN | 101763807 | A | 6/2010 |
| CN | 101814268 | A | 8/2010 |
| CN | 102654975 | A | 9/2012 |
| JP | 2009-008799 | A | 1/2009 |

OTHER PUBLICATIONS

First Chinese Office Action dated Dec. 20, 2013; Appln. No. 201110340564.6.

First Korea Office Action dated Dec. 25, 2013; Appln. No. 10-2012-7032551.

Second Korea Office Action dated Feb. 26, 2014; Appln. No. 10-2012-7032551.

International Preliminary Report on Patentability dated May 6, 2014; PCT/CN2012/082032.

Korean Rejection Decision Appln. No. 10-2012-7032551; Issued Aug. 26, 2014.

* cited by examiner

AMOLED DRIVING AND COMPENSATING CIRCUIT AND METHOD, AND AMOLED DISPLAY DEVICE

TECHNICAL FIELD

The present disclosure relates to AMOLED field, in particular to an AMOLED driving and compensating circuit and method, and AMOLED display device.

BACKGROUND

Active Matrix Organic Light Emitting Diode (AMOLED) can emit light, when the AMOLED is driven by a driving current produced from a driving thin film transistor in a driving circuit. However, as the change of time, threshold voltage of the driving thin film transistor may change. As a result, when the same grayscale voltage is input, the driving current produced is inconsistent, such that luminance of the driven AMOLED is different. At present, a major method for solving the problem is to add a compensating circuit to eliminate an effect of the threshold voltage, so as to achieve a consistent driving current and improve luminance uniformity of the AMOLED.

In a process of implementing the present disclosure, the inventor finds that the prior art has at least the below problem:

The existing AMOLED compensating circuit often needs five or six thin film transistors to be set inside the same pixel region, which thus may reduce aperture ratio.

SUMMARY

An embodiment of the present disclosure provides an AMOLED driving and compensating circuit and method, and AMOLED display device, being capable of increasing aperture ratio.

According to the embodiment of the present disclosure, provided is an AMOLED driving and compensating circuit, comprising:

Several driving circuits set inside several pixel regions used for driving several AMOLEDs, wherein one AMOLED and one corresponding driving circuit are set inside each of pixel regions, and one driving circuit is used for driving one corresponding AMOLED;

An external compensating circuit set outside the pixel regions used for eliminating an effect of threshold voltage of driving thin film transistors in the several driving circuits set inside the several pixel regions on driving currents passing through the driving thin film transistors.

In one example, each of the several driving circuits set inside the several pixel regions comprising: a first thin film transistor, a driving capacitor and a driving thin film transistor;

The first thin film transistor has a source connected to a data line;

The driving capacitor has a first terminal connected to a drain of the first thin film transistor; and The driving thin film transistor has a gate connected to the drain of the first thin film transistor, Wherein an input terminal of the AMOLED corresponding to the driving circuit is connected to an output terminal of operating voltage, and an output terminal of the AMOLED corresponding to the driving circuit is connected to a drain of the driving thin film transistor;

The first thin film transistor and the driving thin film transistor are n-channel thin film transistors;

In one example, the external compensating circuit set outside the pixel regions comprises: a second thin film transistor, a third thin film transistor, a compensating capacitor, a fourth thin film transistor, a fifth thin film transistor, a sixth thin film transistor and a seventh thin film transistor;

The second thin film transistor has a source connected to ground, a gate connected to a second clock signal output terminal, and a drain connected to a second terminal of the driving capacitor;

The third thin film transistor has a source connected to the drain of the second thin film transistor, and a gate connected to the second clock signal output terminal;

The compensating capacitor has a first terminal connected to a drain of the third thin film transistor;

The fourth thin film transistor has a source connected to a second terminal of the compensating capacitor, a gate connected to the second clock signal output terminal, and a drain connected to a source of the driving thin film transistor;

The fifth thin film transistor has a source connected to ground, a gate connected to a first clock signal output terminal, and a drain connected to the source of the fourth thin film transistor;

The sixth thin film transistor has a source connected to a reference voltage output terminal, a gate connected to the first clock signal output terminal, and a drain connected to the drain of the second thin film transistor;

The seventh thin film transistor has a source connected to the reference voltage output terminal, a gate connected to the first clock signal output terminal, and a drain connected to the gate of the driving thin film transistor; and A gate of the first thin film transistor is connected to the second clock signal output terminal, Wherein the second thin film transistor, the sixth thin film transistor and the seventh thin film transistor are n-channel thin film transistors;

The third thin film transistor, the fourth thin film transistor and the fifth thin film transistor are p-channel thin film transistors.

In one example, both a first clock signal at the first clock signal output terminal and a second clock signal at the second clock signal output terminal comprise a first phase, a second phase and a third phase;

At the first phase, the first clock signal output terminal is at high level, and the second clock signal output terminal is at low level;

At the second phase, the first clock signal output terminal is at low level, and the second clock signal output terminal is at high level;

At the third phase, the first clock signal output terminal is at low level, and the second clock signal output terminal is at low level.

In one example, at the first phase, the third thin film transistor, the fourth thin film transistor, the sixth thin film transistor and the seventh thin film transistor in the external compensating circuit turn on, and the first thin film transistor in each of the driving circuits and the second thin film transistor and the fifth thin film transistor in the external compensating circuit turn off, such that voltage difference over the compensating capacitor becomes the threshold voltage of the driving thin film transistor;

At the second phase, the third thin film transistor, the fourth thin film transistor, the sixth thin film transistor and the seventh thin film transistor in the external compensating circuit turn off, and the first thin film transistor in each of the driving circuits and the second thin film transistor and the fifth thin film transistor in the external compensating circuit turn on, such that the voltage difference over the driving capacitor in each of the driving circuits becomes a grayscale voltage input from a data line corresponding to the driving circuit; and At the third phase, the third thin film transistor, the fourth thin film transistor, and the fifth thin film transistor in the external compensating circuit turn on, and the first thin film transistor in each of the driving circuits and the second thin film transistor, the sixth thin film transistor and the seventh thin film transistor in the external compensating circuit turn off, such that the gate voltage of the driving thin film transistor in the driving circuit jumps to a sum of the threshold voltage of the driving thin film transistor and the grayscale voltage input from the data line corresponding to the driving circuit.

According to an embodiment of the present disclosure, further provided is an AMOLED driving and compensating method, comprising:

A first phase, storing a threshold voltage of driving thin film transistors of several driving circuits set inside several pixel regions;

A second phase, storing a grayscale voltage of each of the several driving circuits set inside the several pixel regions;

A third phase, a gate voltage of the driving thin film transistor of each of the several driving circuits set inside the several pixel regions jumping to a sum of the threshold voltage and the grayscale voltage of the driving circuit.

In one example, at the first phase, storing the threshold voltage of the driving thin film transistors of the several driving circuits set inside the several pixel regions is:

A first clock signal output terminal is at high level, a second clock signal output terminal is at low level, a third thin film transistor, a fourth thin film transistor, a sixth thin film transistor and a seventh thin film transistor in a compensating circuit turn on, a first thin film transistor in each of the driving circuits and a second thin film transistor and a fifth thin film transistor in the compensating circuit turn off, and voltage difference over a compensating capacitor becomes the threshold voltage of the driving thin film transistors of the several driving circuits set inside the several pixel regions;

At the second phase, storing the grayscale voltage of each of the several driving circuits set inside the several pixel regions is:

The first clock signal output terminal is at low level, the second clock signal output terminal is at high level, the third thin film transistor, the fourth thin film transistor, the sixth thin film transistor and the seventh thin film transistor in the compensating circuit turn off, the first thin film transistor in each of the driving circuits and the second thin film transistor and the fifth thin film transistor in the compensating circuit turn on, and the voltage difference over the compensating capacitor in each of the driving circuits becomes the grayscale voltage input from the data line corresponding to the driving circuit;

At the third phase, the gate voltage of the driving thin film transistor of each of the several driving circuits set inside the several pixel regions jumping to the sum of the threshold voltage and the grayscale voltage of the driving circuit is:

The first clock signal output terminal is at low level, the second clock signal output terminal is at low level, the third thin film transistor, the fourth thin film transistor and the fifth thin film transistor in the compensating circuit turn on, the first thin film transistor in each of the driving circuits and the second thin film transistor, the sixth thin film transistor and the seventh thin film transistor in the compensating circuit turn off, and the gate voltage of the driving thin film transistor in each of the several driving circuits set inside the several pixel regions jumps to the sum of the threshold voltage and the grayscale voltage of the driving circuit.

A display device comprising the AMOLED driving and compensating circuit.

The AMOLED driving and compensating circuit and method provided in the embodiment of the present disclosure, due to an external compensating circuit set outside pixel regions, is capable of simultaneously compensating threshold voltage of driving thin film transistors of several driving circuits inside the pixel regions, and there is only a driving circuit used for driving the AMOLED in each of the pixel regions, so that aperture ratio is increased.

BRIEF DESCRIPTION OF THE DRAWINGS

In order to more clearly specify the technical solution in the embodiment of the present disclosure or the prior art, below will be a brief introduction of drawings needed to be used in descriptions of the embodiment or the prior art. Obviously, the drawings in the below descriptions are merely some embodiments of the present disclosure. For those ordinarily skilled in the art, they may obtain other drawings in the light of these drawings, without paying any inventive labor.

DETAILED DESCRIPTION

The technical solution in the embodiments of the present disclosure will be clearly and completely described by combining with the accompanying drawings in the embodiments of the present disclosure. Obviously, the embodiments described are merely a portion of the embodiments of the present disclosure, rather than all embodiments. Based on the embodiments in the present disclosure, all the other embodiments obtained by those ordinarily skilled in the art without paying any inventive labor belong to the scope sought for protection in the present disclosure.

One embodiment of the present disclosure provides an AMOLED driving and compensating circuit, comprising:

Several driving circuits set inside several pixel regions used for driving several AMOLEDs, wherein one AMOLED and one corresponding driving circuit arc set inside each of the pixel regions, and one driving circuit is used for driving one corresponding AMOLED;

Each of the driving circuits, such as a traditional 2T1C (two thin film transistors and one capacitor) circuit, comprises a first thin film transistor, a driving thin film transistor and a driving capacitor, a driving current passing through the driving thin film transistor drives the AMOLED to emit light;

An external compensating circuit set outside the pixel regions used for eliminating an effect of threshold voltage of the driving thin film transistors in the several driving circuits set inside the pixel regions on driving currents passing through the driving thin film transistors, such that the driving current passing through the driving thin film transistor is irrelevant to threshold voltage of the driving thin film transistor, thus improving consistency of the driving current.

Besides the driving circuit, the prior art further needs to set, in each of the pixel regions, a compensating circuit composed of five to six thin film transistors, while the AMOLED driving and compensating circuit provided in the embodiment of the present disclosure, due to the external compensating circuit set outside the pixel regions, is capable of simultaneously compensating the threshold voltage of the driving thin film transistors of the several driving circuit inside the pixel regions, and there is only the driving circuit for driving the AMOLED in each of the pixel regions, so that aperture ratio is increased.

Figure 1:
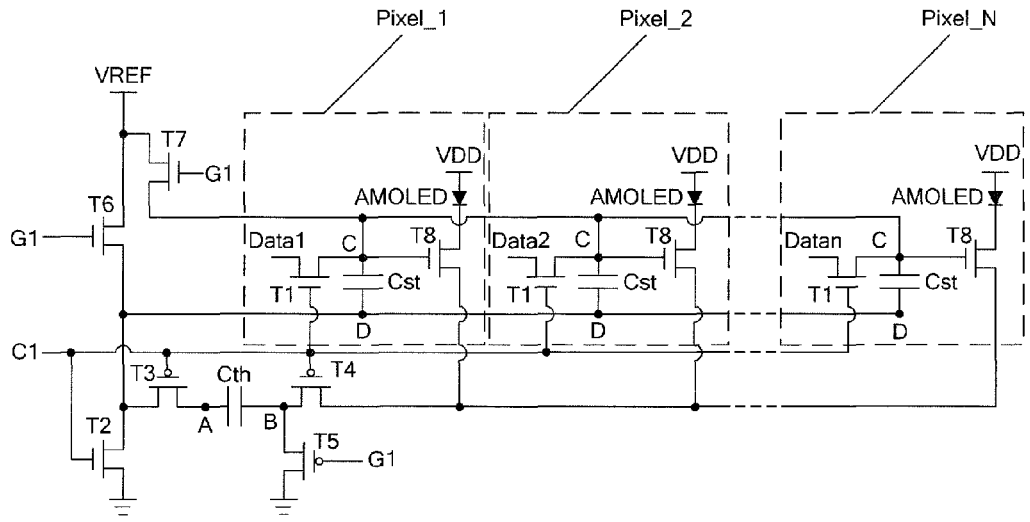
FIG. 1 is a circuit diagram of an AMOLED driving and compensating circuit provided in the embodiments of the present disclosure.

In particular, as shown in FIG. 1, a row of pixel regions comprises N pixel regions Pixel_1, Pixel_2, . . . , Pixel_N, wherein N is a natural number larger than 1. One AMOLED and one corresponding driving circuit are respectively set in each of the pixel regions.

In each of the pixel regions, the driving circuit comprises: a first thin film transistor T1, a driving capacitor Cst and a driving thin film transistor T8; wherein the first thin film transistor T1 has a source connected to a data line; the driving capacitor Cst has a first terminal connected to a drain of the first thin film transistor T1; and the driving thin film transistor T8 has a gate connected to the drain of the first thin film transistor T1. In addition, in each of the pixel regions, the anode of the AMOLED is connected to an output terminal of operating voltage, in particular, the voltage source VDD, and the cathode of AMOLED is connected to a drain of the driving thin film transistor T8 of the driving circuit set inside the pixel region. The first thin film transistor and the driving thin film transistor are n-channel thin film transistors.

In addition, sources of N first thin film transistors T1 inside N pixel regions are respectively connected to N data lines Data1, Data2, . . . , DataN.

The external compensating circuit set outside the pixel regions comprises: a second thin film transistor T2, a third thin film transistor T3, a compensating capacitor Cth, a fourth thin film transistor T4, a fifth thin film transistor T5, a sixth thin film transistor T6 and a seventh thin film transistor T7; wherein the second thin film transistor T2 has a source connected to ground, a gate connected to a second clock signal output terminal C1, and a drain connected to a second terminal of the driving capacitor Cst; the third thin film transistor T3 has a source connected to the drain of the second thin film transistor T2, and a gate connected to the second clock signal output terminal C1; the compensating capacitor Cth has a first terminal connected to a drain of the third thin film transistor T3; the fourth thin film transistor T4 has a source connected to a second terminal of the compensating capacitor Cth, a gate connected to the second clock signal output terminal C1, and a drain connected to a source of the driving thin film transistor T8; the fifth thin film transistor T5 has a source connected to ground, a gate connected to a first clock signal output terminal G1, and a drain connected to the source of the fourth thin film transistor T4; the sixth thin film transistor T6 has a source connected to a reference voltage output terminal VREF, a gate connected to the first clock signal output terminal G1, and a drain connected to the drain of the second thin film transistor T2; the seventh thin film transistor T7 has a source connected to the reference voltage output terminal VREF, a gate connected to the first clock signal output terminal G1, and a drain connected to the gate of the driving thin film transistor T8; and a gate of the first thin film transistor T1 is connected to the second clock signal output terminal C1. The second thin film transistor T2, the sixth thin film transistor T6 and the seventh thin film transistor T7 are n-channel thin film transistors; the third thin film transistor T3, the fourth thin film transistor T4 and the fifth thin film transistor 15 are p-channel thin film transistors.

Figure 2:
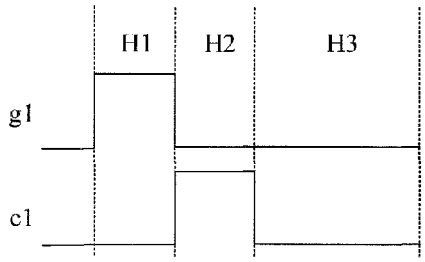
FIG. 2 is a timing sequence diagram of the clock signal of the circuit in FIG. 1.

Further, as show in FIG. 2, both a first clock signal g1 at the first clock signal output terminal G1 and a second clock signal c1 at the second clock signal output terminal C1 comprise a first phase H1, a second phase H2 and a third phase H3; at the first phase H1, the first clock signal output terminal G1 is at high level, and the second clock signal output terminal C1 is at low level; at the second phase H2, the first clock signal output terminal G1 is at low level, and the second clock signal output terminal C1 is at high level; at the third phase H3, the first clock signal output terminal G1 is at low level, and the second clock signal output terminal C1 is at low level;

Detailed description will be given to the present solution below with reference to the charging process of a row of pixels. As shown in FIG. 1, it is prescribed that: a first terminal of the compensating capacitor Cth connected to the third thin film transistor T3 is a first node A; a second terminal of the compensating capacitor Cth connected to the fourth thin film transistor T4 is a second node B; a first terminal of the driving capacitor Cst connected to the first thin film transistor T1 is a third node C; a second terminal of the driving capacitor Cst connected to the second thin film transistor T2 is a fourth node D.

Figure 3:
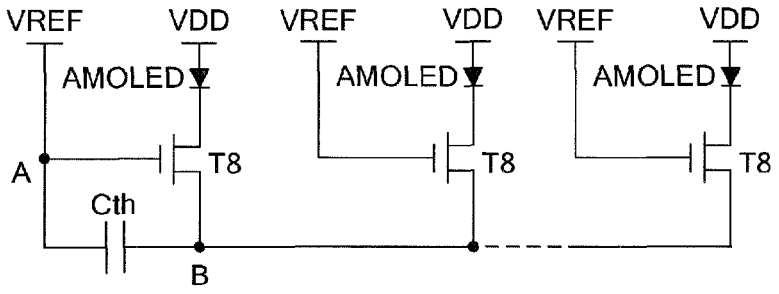
FIG. 3 is an equivalent circuit diagram of the circuit in FIG. 1 at a first phase.

The first phase H1 is a precharge phase. At this time, the first clock signal output terminal G1 is at high level, the second clock signal output terminal C1 is at low level, the third thin film transistor T3, the fourth thin film transistor T4, the sixth thin film transistor T6 and the seventh thin film transistor T7 in the compensating circuit turn on, and the first thin film transistor T1 in each of the driving circuits and the second thin film transistor T2 and the fifth thin film transistor T5 in the compensating circuit turn off. At this time, the circuit is equivalent to the circuit as shown in FIG. 3. The reference voltage output terminal VREF charges the compensating capacitor Cth, such that the voltage of the first node A is the reference voltage Vref at the reference voltage output terminal VREF, and the voltage of the second node B is a difference of the reference voltage Vref and the threshold reference Vth of the driving thin film transistor T8, i.e., Vref−Vth. That is, the voltage difference over the compensating capacitor Cth is the threshold voltage Vth of the driving thin film transistor T8. It should be noted that, it is necessary for the driving thin film transistors T8 inside the row of pixel regions to be produced by adopting the same technique, so as to guarantee the threshold voltage of each of the driving thin film transistors T8 in the row to be the same and equal to Vth.

Figure 4:
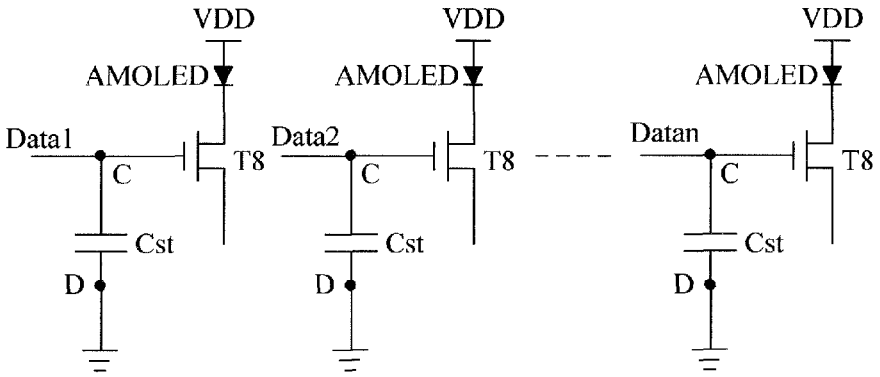
FIG. 4 is an equivalent circuit diagram of the circuit in FIG. 1 at a second phase.

The second phase H2 is a grayscale voltage input phase. At this time, the first clock output terminal G1 is at low level, the second clock signal output terminal C1 is at high level, the third thin film transistor T3, the fourth thin film transistor T4, the sixth thin film transistor T6 and the seventh thin film transistor T7 in the compensating circuit turn off, and the first thin film transistor T1 in each of the driving circuits and the second thin film transistor T2 and the fifth thin film transistor T5 in the compensating circuit turn on. At this time, the circuit is equivalent to the circuit as shown in FIG. 4. Below is a specification of the present solution by taking the operating principle of the driving circuit inside one pixel region Pixel_1 as an example. The data line Data1 charges the driving capacitor Cst, such that the voltage of the third node C is the grayscale voltage Vdata1 input from the data line Data1, and the voltage of the fourth node D is zero. That is, the voltage difference over the driving capacitor Cst is the grayscale voltage Vdata1 input from the data line Data1.

Figure 5:
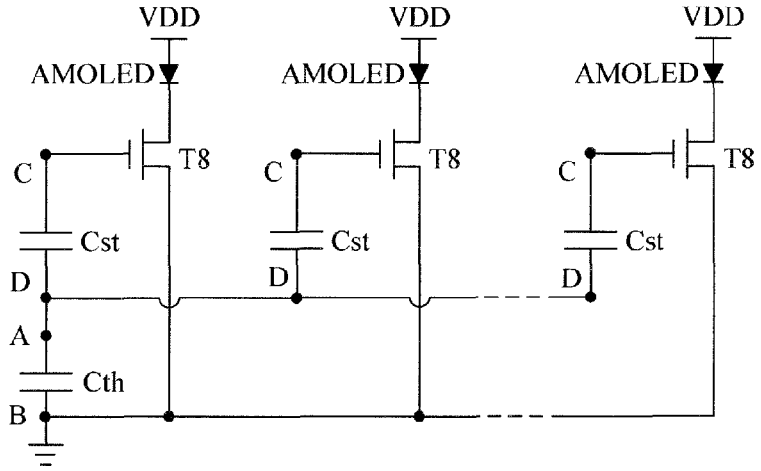
FIG. 5 is an equivalent circuit diagram of the circuit in FIG. 1 at a third phase.

The third phase H3 is a light emitting phase. At this time, the first clock output terminal G1 is at low level, the second clock signal output terminal C1 is at low level, the third thin film transistor T3, the fourth thin film transistor T4, and the fifth thin film transistor T5 in the compensating circuit turn on, and the first thin film transistor T1 in each of the driving circuits and the second thin film transistor T2, the sixth thin film transistor T6 and the seventh thin film transistor T7 in the compensating circuit turn off At this time, the circuit is equivalent to the circuit as shown in FIG. 5. The second node B is connected to ground and the voltage thereof is zero. Since at the first phase H1, the voltage difference stored on the compensating capacitor Cth is the threshold voltage Vth of the driving thin film transistor T8, thus at the third phase H3, the voltage of the first node A, i.e., the fourth node D, is the threshold voltage Vth of the driving thin film transistor T8; and since at the second phase H2, taking the driving circuit inside the pixel region Pixel_1 as an example, the voltage difference over the driving capacitor Cst is the grayscale voltage Vdata1 input from the data line Data1; thus at the third phase H3, still taking the driving circuit inside the pixel region Pixel_1 as an example, the voltage of the third node C jumps to the sum of the threshold voltage Vth of the driving thin film transistor T8 and the grayscale voltage Vdata1 input from the data line Data1, being Vth+Vdata1, that is, the gate voltage Vgs of the driving thin film transistor T8 is Vth+Vdata1, and the driving current passing through the driving thin film transistor T8 is:

$$I=k(Vgs-Vth)^2=k(V\text{data1}+Vth-Vth)^2=k(V\text{data1})^2,$$

Wherein k=μeff×Cox×(W/L)/2, μeff represents effective carrier mobility of the driving thin film transistor T8, Cox represents the gate insulation dielectric constant of the driving thin film transistor T8, and W/L represents the channel width to length ratio of the driving thin film transistor T8.

According to the equation described above, the driving current I passing through the driving thin film transistor T8 is irrelevant to the threshold voltage Vth thereof, and the effect of the threshold voltage Vth of the driving thin film transistor T8 on the driving current I passing through the driving thin film transistor T8 is eliminated.

The reference voltage output terminal may be the power supply terminal VDD. The time for the first phase H1 and the second phase H2 is relatively short, while the time for the third phase H3 is relatively long for making the AMOLED emit light to be displayed.

The equation of the driving current in the prior art commonly comprises the power supply voltage Vdd of the power supply terminal VDD. The change of the power supply voltage Vdd due to the voltage drop (IR drop) will further influence the display effect of the AMOLED, while the equation of the driving current in the embodiment of the present disclosure does not comprise the power supply voltage Vdd of the power supply terminal VDD, so as to further improve the consistency of the driving current by eliminating the effect of IR Drop.

The operating principle of the driving circuits inside each of the pixel regions in a row is the same as that of the driving circuit inside one pixel region Pixel_1, details omitted.

In short, for the driving circuit inside the $i^{th}$ pixel region Pixel_i (i is a natural number more than 1 and less than or equal to N) in the N pixel regions Pixel_1, Pixel_2, . . . , Pixel_N, at the second phase H2, the voltage difference over the driving capacitor Cst is the grayscale voltage Vdatai input from the data line Datai, and at the third phase H3, the voltage of the third node C jumps to the sum of the threshold voltage Vth of the driving thin film transistor T8 and the grayscale voltage Vdatai input from the data line Datai, being Vth+Vdatai, that is, the gate voltage Vgs of the driving thin film transistor T8 is Vth+Vdatai, and the driving current passing through the driving thin film transistor T8 is:

$$I=K(Vgs-Vth)^2=k(V\text{data1}+Vth-Vth)^2=k(V\text{data1})^2,$$

Figure 6:
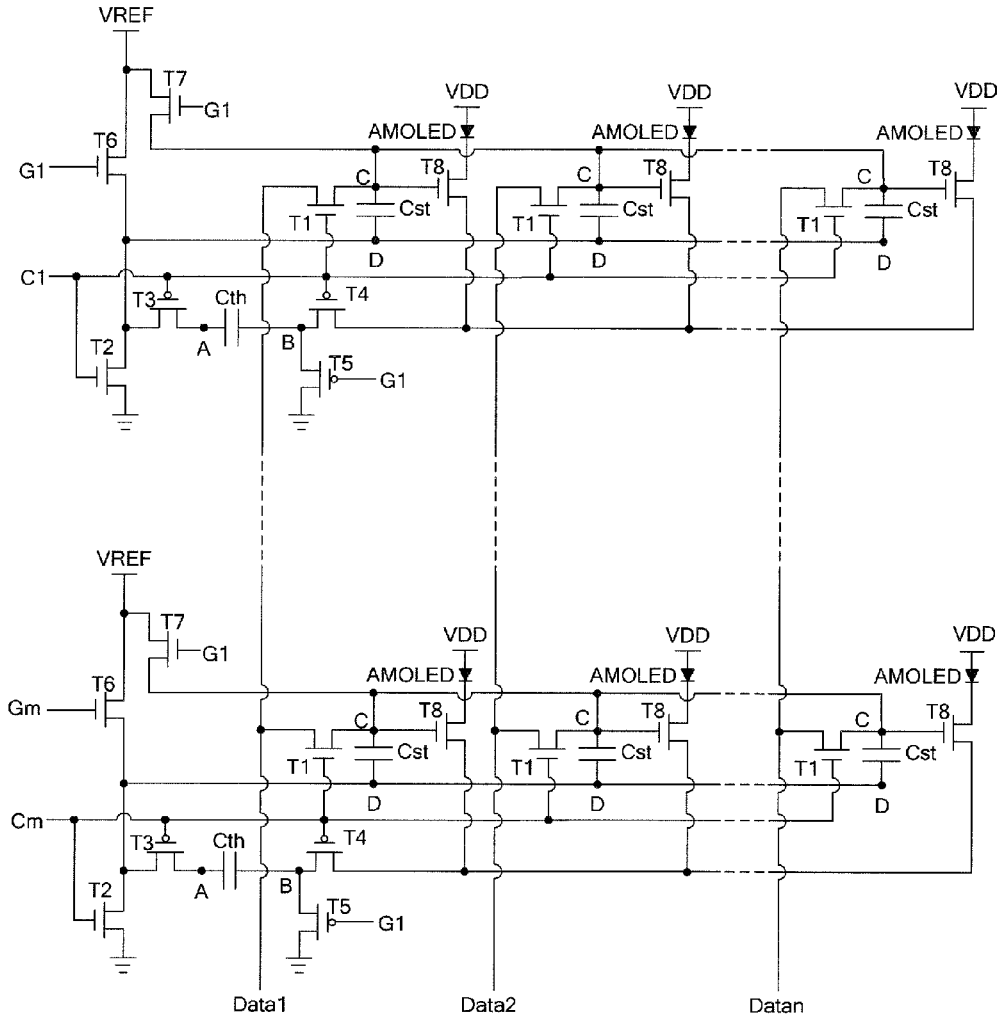
FIG. 6 is a circuit diagram of another AMOLED driving and compensating circuit provided in the embodiments of the present disclosure.

Above is a detailed description of the present solution merely in the charging process of a row of pixel regions. As shown in FIG. 6, for m rows of pixel regions, an AMOLED driving and compensating circuit can be formed by setting, outside the respective m rows of pixel regions, m external compensating circuits corresponding thereto. The AMOLED driving and compensating circuit comprises: m first clock signal output terminals G1, G2, . . . , Gm; m second clock signal output terminals C1, C2, . . . , Cm, wherein m is a natural number larger than 1. The connecting relationship and operating principle of the AMOLED driving and compensating circuit is the same as the embodiment described above, details omitted.

The AMOLED driving and compensating circuit provided in the embodiment of the present disclosure makes the external compensating circuit outside a row of pixel region simultaneously compensate the threshold voltage of the driving thin film transistors of the several driving circuit inside the row of pixel regions, and there is only the driving circuit for driving the AMOLED in each of the pixel regions, so as to increase the aperture ratio.

Figure 7:
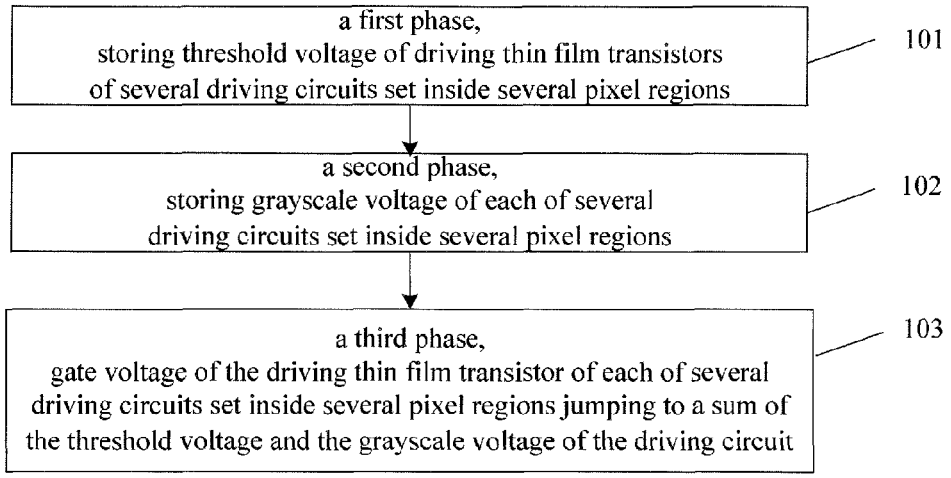
FIG. 7 is a flow chart of an AMOLED driving and compensating method provided in the embodiments of the present disclosure.

The embodiment of the present disclosure further provides an AMOLED driving and compensating method which is applied to the AMOLED driving and compensating circuit provided in the above embodiment, as shown in FIG. 7, comprising:

Step 101, at the first phase, storing the threshold voltage of the driving thin film transistors of several driving circuits set inside several pixel regions;

Step 102, at the second phase, storing the grayscale voltage of each of the several driving circuits set inside the several pixel regions;

Step 103, at the third phase, the gate voltage of the driving thin film transistor of each of the several driving circuits set inside the several pixel regions jumping to the sum of the threshold voltage and the grayscale voltage of the driving circuit.

The AMOLED driving and compensating method provided in the embodiment of the present disclosure, due to the external compensating circuit set outside the pixel region, simultaneously compensates the threshold voltage of the driving thin film transistors of several driving circuit inside the pixel regions, and there is only a driving circuit for driving the AMOLED in each of the pixel regions, so as to increase the aperture ratio.

At the first phase, storing the threshold voltage of the driving thin film transistors of the several driving circuits set inside the several pixel regions particularly is:

The first clock signal output terminal is at high level, the second clock output terminal signal is at low level, the third thin film transistor, the fourth thin film transistor, the sixth thin film transistor and the seventh thin film transistor in the compensating circuit turn on, the first thin film transistor in each of the driving circuits and the second thin film transistor and the fifth thin film transistor in the compensating circuit turn off, and voltage difference over the compensating capacitor is the threshold voltage of the driving thin film transistors of the several driving circuits set inside the several pixel regions;

At the second phase, storing the grayscale voltage of each of the several driving circuits set inside the several pixel regions particularly is:

The first clock signal output terminal is at low level, the second clock signal output terminal is at high level, the third thin film transistor, the fourth thin film transistor, the sixth thin film transistor and the seventh thin film transistor in the compensating circuit turn off, the first thin film transistor in each of the driving circuits and the second thin film transistor and the fifth thin film transistor in the compensating circuit turn on, and the voltage difference over the compensating capacitor in each of the driving circuits is the grayscale voltage input from the data line corresponding to the driving circuit;

At the third phase, the gate voltage in the driving thin film transistor of each of the several driving circuits set inside the several pixel regions jumping to the sum of the threshold voltage and the grayscale voltage of the driving circuit particularly is:

The first clock signal output terminal is at low level, the second clock signal output terminal is at low level, the third thin film transistor, the fourth thin film transistor and the fifth thin film transistor in the compensating circuit turn on, the first thin film transistor in each of the driving circuits and the second thin film transistor, the sixth thin film transistor and the seventh thin film transistor in the compensating circuit turn off, and the gate voltage of the driving thin film transistor in each of the several driving circuits set inside the several pixel regions jumps to the sum of the threshold voltage and the grayscale voltage of the driving circuit.

The particular operating principle of the AMOLED driving and compensating method provided in the embodiment of the present invention is the same as the embodiment described above, details omitted.

The external compensating circuit set outside the pixel regions simultaneously compensates the threshold voltage of the driving thin film transistors of several driving circuits inside the pixel regions, and there is only the driving circuit for driving the AMOLED in each of the pixel regions, so as to increase the aperture ratio.

The embodiment of the present disclosure further provides a display device, comprising the AMOLED driving and compensating circuit described above. The corresponding driving and compensating method and the operating principle are the same as the embodiment described above, details omitted.

The external compensating circuit set outside the pixel region simultaneously compensates the threshold voltage of the driving thin film transistors of several driving circuits inside the pixel regions, and there is only the driving circuit for driving the AMOLED in each of the pixel regions, so as to increase the aperture ratio.

The above are described in details the embodiment of the present disclosure, however, the scope sought for protection in the present disclosure is not limited thereto. Any modification or replacement within the technical scope disclosed in the present disclosure easily conceived by those skilled in the art should be considered as falling into the protection scope of the present disclosure. Therefore, the scope sought for protection in the present disclosure should be subject to the scope sought for protection in the Claims.

What is claimed is:

1. An AMOLED driving and compensating circuit comprising:

several driving circuits set inside several pixel regions used for driving several AMOLEDs, wherein one AMOLED and one corresponding driving circuit are set inside each of the pixel regions, and one driving circuit is used for driving one corresponding AMOLED;

an external compensating circuit set outside the pixel regions used for eliminating an effect of threshold voltage of driving thin film transistors in the several driving circuits set inside the several pixel regions on driving currents passing through the driving thin film transistors, wherein, the external compensating circuit set outside the pixel regions comprises:

a second thin film transistor, a third thin film transistor, a compensating capacitor, a fourth thin film transistor, a fifth thin film transistor, a sixth thin film transistor and a seventh thin film transistor;

the second thin film transistor has a source connected to ground, a gate connected to a second clock signal output terminal, and a drain connected to a second terminal of the driving capacitor;

the third thin film transistor has a source connected to the drain of the second thin film transistor, and a gate connected to the second clock signal output terminal;

the compensating capacitor has a first terminal connected to a drain of the third thin film transistor;

the fourth thin film transistor has a source connected to a second terminal of the compensating capacitor, a gate connected to the second clock signal output terminal, and a drain connected to a source of the driving thin film transistor;

the fifth thin film transistor has a source connected to ground, a gate connected to a first clock signal output terminal, and a drain connected to the source of the fourth thin film transistor;

the sixth thin film transistor has a source connected to a reference voltage output terminal, a gate connected to the first clock signal output terminal, and a drain connected to the drain of the second thin film transistor;

the seventh thin film transistor has a source connected to the reference voltage output terminal, a gate connected to the first clock signal output terminal, and a drain connected to the gate of the driving thin film transistor; and a gate of the first thin film transistor is connected to the second clock signal output terminal, wherein the second thin film transistor, the sixth thin film transistor and the seventh thin film transistor are n-channel thin film transistors;

the third thin film transistor, the fourth thin film transistor and the fifth thin film transistor are p-channel thin film transistors.

2. The AMOLED driving and compensating circuit as claimed in claim 1, wherein, each of the several driving circuits set inside the several pixel regions comprises: a first thin film transistor, a driving capacitor and a driving thin film transistor;

the first thin film transistor has a source connected to a data line;

the driving capacitor has a first terminal connected to a drain of the first thin film transistor; and the driving thin film transistor has a gate connected to the drain of the first thin film transistor, wherein an input terminal of the AMOLED corresponding to the driving circuit is connected to an output terminal of operating voltage, and an output terminal of the AMOLED corresponding to the driving circuit is connected to a drain of the driving thin film transistor;

the first thin film transistor and the driving thin film transistor are n-channel thin film transistors.

3. The AMOLED driving and compensating circuit as claimed in claim 1, wherein, both a first clock signal at the first clock signal output terminal and a second clock signal at the second clock signal output terminal comprise a first phase, a second phase and a third phase;

at the first phase, the first clock signal output terminal is at high level, and the second clock signal output terminal is at low level;

at the second phase, the first clock signal output terminal is at low level, and the second clock signal output terminal is at high level;

at the third phase, the first clock signal output terminal is at low level, and the second clock signal output terminal is at low level.

4. The AMOLED driving and compensating circuit as claimed in claim 3, wherein, at the first phase, the third thin film transistor, the fourth thin film transistor, the sixth thin film transistor and the seventh thin film transistor in the external compensating circuit turn on, and the first thin film transistor in each of the driving circuits and the second thin film transistor and the fifth thin film transistor in the external compensating circuit turn off, such that voltage difference over the compensating capacitor becomes threshold voltage of the driving thin film transistor;

at the second phase, the third thin film transistor, the fourth thin film transistor, the sixth thin film transistor and the seventh thin film transistor in the external compensating circuit turn off, and the first thin film transistor in each of the driving circuits and the second thin film transistor and the fifth thin film transistor in the external compensating circuit turn on, such that voltage difference over the driving capacitor in each of the driving circuits becomes grayscale voltage input from a data line corresponding to the driving circuit; and at the third phase, the third thin film transistor, the fourth thin film transistor and the fifth thin film transistor in the external compensating circuit turn on, and the first thin film transistor in each of the driving circuits and the second thin film transistor, the sixth thin film transistor and the seventh thin film transistor in the external compensating circuit turn off, such that gate voltage of a driving thin film transistor in the driving circuit jumps to a sum of the threshold voltage of the driving thin film transistor and the grayscale voltage input from the data line corresponding to the driving circuit.

5. An AMOLED driving and compensating method, comprising:

a first phase, storing threshold voltage of driving thin film transistors of several driving circuits set inside several pixel regions;

a second phase, storing grayscale voltage of each of the several driving circuits set inside the several pixel regions;

a third phase, gate voltage of the driving thin film transistor of each of the several driving circuits set inside the several pixel regions lumping to a sum of the threshold voltage and the qrayscale voltage of the driving circuit, wherein, at the first phase, storing the threshold voltage of the driving thin film transistors of the several driving circuits set inside the several pixel regions is:

a first clock signal output terminal is at high level, a second clock signal output terminal is at low level, a third thin film transistor, a fourth thin film transistor, a sixth thin film transistor and a seventh thin film transistor in a compensating circuit turn on, a first thin film transistor in each of the driving circuits and a second thin film transistor and a fifth thin film transistor in the compensating circuit turn off, and voltage difference over a compensating capacitor becomes the threshold voltage of the driving thin film transistors of the several driving circuits set inside the several pixel regions;

at the second phase, storing the grayscale voltage of each of the several driving circuits set inside the several pixel regions is:

the first clock signal output terminal is at low level, the second clock signal output terminal is at high level, the third thin film transistor, the fourth thin film transistor, the sixth thin film transistor and the seventh thin film transistor in the compensating circuit turn off, the first thin film transistor in each of the driving circuits and the second thin film transistor and the fifth thin film transistor in the compensating circuit turn on, and the voltage difference over the compensating capacitor in each of the driving circuits is the grayscale voltage input from the data line corresponding to the driving circuit;

at the third phase, the gate voltage of the driving thin film transistor of each of the several driving circuits set inside the several pixel regions jumping to the sum of the threshold voltage and the grayscale voltage of the driving circuit is:

the first clock signal output terminal is at low level, the second clock signal output terminal is at low level, the third thin film transistor, the fourth thin film transistor and the fifth thin film transistor in the compensating circuit turn on, the first thin film transistor in each of the driving circuits and the second thin film transistor, the sixth thin film transistor and the seventh thin film transistor in the compensating circuit turn off, and the gate voltage of the driving thin film transistor in each of the several driving circuits set inside the several pixel regions jumps to the sum of the threshold voltage and the grayscale voltage of the driving circuit.

6. A display device comprising:

a plurality of rows of pixel regions, each of which comprising several pixel regions, wherein one AMOLED and one corresponding driving circuit are set inside each of the pixel regions, and one driving circuit is used for driving one corresponding AMOLED;

a plurality of external compensating circuits set outside the pixel regions, wherein each of the external compensating circuits is used for compensating the several driving circuit set inside a row of pixel regions, and eliminating an effect of threshold voltage of driving thin film transistors in the several driving circuits on driving currents passing through the driving thin film transistors, wherein, each of the external compensating circuits comprises:

a second thin film transistor, a third thin film transistor, a compensating capacitor, a fourth thin film transistor, a fifth thin film transistor, a sixth thin film transistor and a seventh thin film transistor;

the second thin film transistor has a source connected to ground, a gate connected to a second clock signal output terminal, and a drain connected to a second terminal of the driving capacitor;

the third thin film transistor has a source connected to the drain of the second thin film transistor, and a gate connected to the second clock signal output terminal;

the compensating capacitor has a first terminal connected to a drain of the third thin film transistor;

the fourth thin film transistor has a source connected to a second terminal of the compensating capacitor, a gate connected to the second clock signal output terminal, and a drain connected to a source of the driving thin film transistor;

the fifth thin film transistor has a source connected to ground, a gate connected to a first clock signal output terminal, and a drain connected to the source of the fourth thin film transistor;

the sixth thin film transistor has a source connected to a reference voltage output terminal, a gate connected to the first clock signal output terminal, and a drain connected to the drain of the second thin film transistor;

the seventh thin film transistor has a source connected to the reference voltage output terminal, a gate connected to the first clock signal output terminal, and a drain connected to the gate of the driving thin film transistor; and a gate of the first thin film transistor is connected to the second clock signal output terminal, wherein the second thin film transistor, the sixth thin film transistor and the seventh thin film transistor are n-channel thin film transistors;

the third thin film transistor, the fourth thin film transistor and the fifth thin film transistor are p-channel thin film transistors.

7. The display device as claimed in claim 6, wherein, each of the several driving circuits set inside the several pixel regions comprises: a first thin film transistor, a driving capacitor and a driving thin film transistor;

the first thin film transistor has a source connected to a data line;

the driving capacitor has a first terminal connected to a drain of the first thin film transistor; and the driving thin film transistor has a gate connected to the drain of the first thin film transistor, wherein an input terminal of the AMOLED corresponding to the driving circuit is connected to an output terminal of operating voltage, and an output terminal of the AMOLED corresponding to the driving circuit is connected to a drain of the driving thin film transistor;

the first thin film transistor and the driving thin film transistor are n-channel thin film transistors.

8. The display device as claimed in claim 6, wherein, for each row of the plurality of rows of pixel regions, both a first clock signal at the first clock signal output terminal and a second clock signal at the second clock signal output terminal comprise a first phase, a second phase and a third phase;

at the first phase, the first clock signal output terminal is at high level, and the second clock signal output terminal is at low level;

at the second phase, the first clock signal output terminal is at low level, and the second clock signal output terminal is at high level;

at the third phase, the first clock signal output terminal is at low level, and the second clock signal output terminal is at low level.

9. The display device as claimed in claim 8, wherein, for each row of the plurality of rows of pixel regions, at the first phase, the third thin film transistor, the fourth thin film transistor, the sixth thin film transistor and the seventh thin film transistor in the external compensating circuit corresponding to the row turn on, and the first thin film transistor in each of the driving circuits and the second thin film transistor and the fifth thin film transistor in the external compensating circuit corresponding to the row turn off, such that voltage difference over the compensating capacitor becomes threshold voltage of the driving thin film transistor;

at the second phase, the third thin film transistor, the fourth thin film transistor, the sixth thin film transistor and the seventh thin film transistor in the external compensating circuit corresponding to the row turn off, and the first thin film transistor in each of the driving circuits and the second thin film transistor and the fifth thin film transistor in the external compensating circuit corresponding to the row turn on, such that voltage difference over the driving capacitor in each of the driving circuits becomes grayscale voltage input from a data line corresponding to the driving circuit; and at the third phase, the third thin film transistor, the fourth thin film transistor and the fifth thin film transistor in the external compensating circuit corresponding to the row turn on, and the first thin film transistor in each of the driving circuits and the second thin film transistor, the sixth thin film transistor and the seventh thin film transistor in the external compensating circuit corresponding to the row turn off, such that gate voltage of a driving thin film transistor in the driving circuit jumps to a sum of the threshold voltage of the driving thin film transistor and the grayscale voltage input from the data line corresponding to the driving circuit.

* * * * *